US010227209B2

(12) United States Patent
Collins et al.

(10) Patent No.: US 10,227,209 B2
(45) Date of Patent: Mar. 12, 2019

(54) ORCHESTRATION OF AN OCCUPANT EVACUATION OPERATION USING DESTINATION ENTRY FIXTURES

(71) Applicant: Otis Elevator Company, Farmington, CT (US)

(72) Inventors: James M. Collins, Burlington, CT (US); Jannah A. Stanley, Portland, CT (US); Paul A. Stranieri, Bristol, CT (US); David M. Hughes, East Hampton, CT (US); Ronnie E. Thebeau, Haddam, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/092,278

(22) Filed: Apr. 6, 2016

(65) Prior Publication Data

US 2017/0291796 A1 Oct. 12, 2017

(51) Int. Cl.

| | |
|---|---|
| ***B66B 5/02*** | (2006.01) |
| ***B66B 3/00*** | (2006.01) |
| ***B66B 1/24*** | (2006.01) |
| ***B66B 1/28*** | (2006.01) |

(52) U.S. Cl.

CPC ..... *B66B 5/021* (2013.01); *B66B 1/2408* (2013.01); *B66B 1/28* (2013.01); *B66B 3/00* (2013.01)

(58) Field of Classification Search

USPC ..... 187/247

See application file for complete search history.

(56) References Cited

U.S. PATENT DOCUMENTS

| | | | | |
|---|---|---|---|---|
| 4,248,327 | A * | 2/1981 | Mandel | B66B 3/00 187/391 |
| 5,672,853 | A * | 9/1997 | Whitehall | B66B 1/2408 187/380 |
| 6,105,729 | A * | 8/2000 | Nakamori | B66B 1/462 187/391 |
| 7,182,174 | B2 * | 2/2007 | Parrini | B66B 5/022 182/18 |
| 7,464,793 | B2 | 12/2008 | Komatsu | |
| 7,588,126 | B2 * | 9/2009 | Siikonen | B66B 5/022 187/313 |
| 7,621,378 | B2 | 11/2009 | Kiyoji | |
| 7,677,363 | B2 * | 3/2010 | Kawai | B66B 5/024 187/313 |

(Continued)

FOREIGN PATENT DOCUMENTS

| | | | |
|---|---|---|---|
| CN | 1579914 | A | 2/2005 |
| CN | 102381604 | A | 3/2012 |

(Continued)

OTHER PUBLICATIONS

Touch to Go Technologies; Elevator Touch Screen Systems; 2014 Product Catalog; 43 pgs.

(Continued)

*Primary Examiner* — Christopher Uhlir
(74) *Attorney, Agent, or Firm* — Cantor Colburn LLP

(57) ABSTRACT

A system and method of orchestrating an evacuation operation using an elevator is provided. The method includes displaying that an evacuation request using the elevator is an available option, receiving one or more evacuation requests to use the elevator, and displaying evacuation information.

13 Claims, 6 Drawing Sheets

(56) References Cited

U.S. PATENT DOCUMENTS

| | | | | |
|---|---|---|---|---|
| 7,926,621 | B2 | 4/2011 | Kiyoji et al. | |
| 8,109,368 | B2 | 2/2012 | Yoshiaki | |
| 8,151,942 | B2 | 4/2012 | Rusanen et al. | |
| 8,763,761 | B2 * | 7/2014 | Siikonen | B66B 5/021 187/384 |
| 2004/0163325 | A1 | 8/2004 | Parrini et al. | |
| 2009/0283369 | A1 * | 11/2009 | Flynn | B66B 1/468 187/391 |
| 2011/0128159 | A1 | 6/2011 | Hikita et al. | |

FOREIGN PATENT DOCUMENTS

| | | | |
|---|---|---|---|
| CN | 102642751 | A | 8/2012 |
| CN | 103038150 | A | 4/2013 |
| CN | 103108823 | A | 5/2013 |
| EP | 2253570 | A1 | 11/2010 |
| EP | 2347984 | A2 | 7/2011 |
| JP | 2007161417 | A | 6/2007 |
| JP | 4772457 | B2 | 9/2011 |
| JP | 2013010579 | A | 1/2013 |
| JP | 2013018632 | A | 1/2013 |
| JP | 2013103774 | A | 5/2013 |
| JP | 5617116 | B2 | 11/2014 |
| JP | 2014234274 | A | 12/2014 |
| JP | 5683019 | B2 | 3/2015 |

OTHER PUBLICATIONS

European Search Report for application EP 17165097.1, dated Sep. 6, 2017, 7pgs.

* cited by examiner

ORCHESTRATION OF AN OCCUPANT EVACUATION OPERATION USING DESTINATION ENTRY FIXTURES

TECHNICAL FIELD

The subject matter disclosed herein generally relates to using evacuation using an elevator and, more particularly, to orchestrating an evacuation operation using an elevator.

DESCRIPTION OF RELATED ART

Currently, evacuation scenarios requiring use of elevators for evacuating large numbers of people from a building are lacking in features and control. For example, typically the elevator controller does not know how many occupants are waiting and thus does not dispatch the proper number of elevators to accommodate the group, as it only dispatches one at a time based on the call. Further, it is often unclear to occupants waiting for an elevator how long the wait will be, possibly causing passenger anxiety.

As such, additional indicators to help a user remain informed and aware of the elevator call and progress are desired. Providing an easy and intuitive technique to request an evacuation will limit the confusion and system delays that are typical during an evacuation scenario.

SUMMARY

According to an embodiment, a method of orchestrating an evacuation operation using an elevator is provided. The method includes displaying that an evacuation request using the elevator is an available option, receiving one or more evacuation requests to use the elevator, and displaying evacuation information.

In addition to one or more of the features described above, or as an alternative, further embodiments may include wherein evacuation information includes one or more of a count of evacuation requests, an elevator arrival time estimate, an elevator indicator, a number of detected people waiting, an evacuation map, evacuation instructions, and evacuation warnings.

In addition to one or more of the features described above, or as an alternative, further embodiments may include wherein displaying the evacuation request using the elevator is the available option includes displaying on one or more displays selected from a fixed touch screen, a fixed keypad screen, and a mobile device.

In addition to one or more of the features described above, or as an alternative, further embodiments may include wherein displaying evacuation information includes displaying the evacuation information on one or more displays selected from a fixed touch screen, a fixed keypad screen, and a mobile device.

In addition to one or more of the features described above, or as an alternative, further embodiments may include displaying on a second screen, wherein the second screen is a fixed screen mounted in an elevator lobby, the evacuation information, wherein the second screen is mounted at a height that is equal to or higher than the top of an elevator door entrance.

In addition to one or more of the features described above, or as an alternative, further embodiments may include notifying using an audio signal that that the evacuation request using the elevator is the available option.

In addition to one or more of the features described above, or as an alternative, further embodiments may include notifying using an audio signal the evacuation information that is being displayed.

In addition to one or more of the features described above, or as an alternative, further embodiments may include displaying that all elevators are out of service when an evacuation condition is met, wherein the evacuation condition is one selected from an elevator blockage, an elevator breakage, an elevator power loss, and an elevator being compromised by emergency situation.

In addition to one or more of the features described above, or as an alternative, further embodiments may include calling an elevator car based on the received one or more evacuation requests.

In addition to one or more of the features described above, or as an alternative, further embodiments may include acquiring the number of detected people waiting using one or more sensors that are connected to the elevator.

In addition to one or more of the features described above, or as an alternative, further embodiments may include automatically setting a destination of the elevator based on evacuation settings.

According to an embodiment a system for orchestrating an evacuation operation using an elevator is provided. The system includes an elevator including an elevator controller that is configured to receive an evacuation request and call one or more elevator cars, and the one or more elevator cars that are configured to travel between floors of a building based on the evacuation request received from the elevator controller, and a display configured to display that the evacuation request using the elevator is an available option, receive one or more evacuation requests to use the elevator, and display evacuation information.

In addition to one or more of the features described above, or as an alternative, further embodiments may include a second display configured to display the evacuation information.

In addition to one or more of the features described above, or as an alternative, further embodiments may include wherein evacuation information includes one or more of a count of evacuation requests, an elevator arrival time estimate, an elevator indicator, a number of detected people waiting, an evacuation map, evacuation instructions, and evacuation warnings.

According to an embodiment, a computer program product for orchestrating an evacuation operation using an elevator is provided. The computer program product including a computer readable storage medium having program instructions embodied therewith, the program instructions executable by a processor to cause the processor to display that an evacuation request using the elevator is an available option, receive one or more evacuation requests to use the elevator, and display evacuation information.

In addition to one or more of the features described above, or as an alternative, further embodiments may include additional program instructions executable by the processor to cause the processor to display that the evacuation request using the elevator is the available option on one or more displays selected from a fixed touch screen, a fixed keypad screen, and a mobile device.

In addition to one or more of the features described above, or as an alternative, further embodiments may include additional program instructions executable by the processor to cause the processor to display the evacuation information on one or more displays selected from a fixed touch screen, a fixed keypad screen, and a mobile device.

In addition to one or more of the features described above, or as an alternative, further embodiments may include additional program instructions executable by the processor to cause the processor to display on a second screen, wherein the second screen is a fixed screen mounted in an elevator lobby, the evacuation information, wherein the second screen is mounted at a height that is equal to or higher than the top of an elevator door entrance.

In addition to one or more of the features described above, or as an alternative, further embodiments may include additional program instructions executable by the processor to cause the processor to notify using an audio signal that that the evacuation request using the elevator is the available option, and notify using an audio signal the evacuation information that is being displayed.

In addition to one or more of the features described above, or as an alternative, further embodiments may include additional program instructions executable by the processor to cause the processor to display that all elevators are out of service when an evacuation condition is met, wherein the evacuation condition is one selected from an elevator blockage, an elevator breakage, an elevator power loss, and an elevator being compromised by emergency situation.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the present disclosure are apparent from the following detailed description taken in conjunction with the accompanying drawings in which.

DETAILED DESCRIPTION

Figure 1:
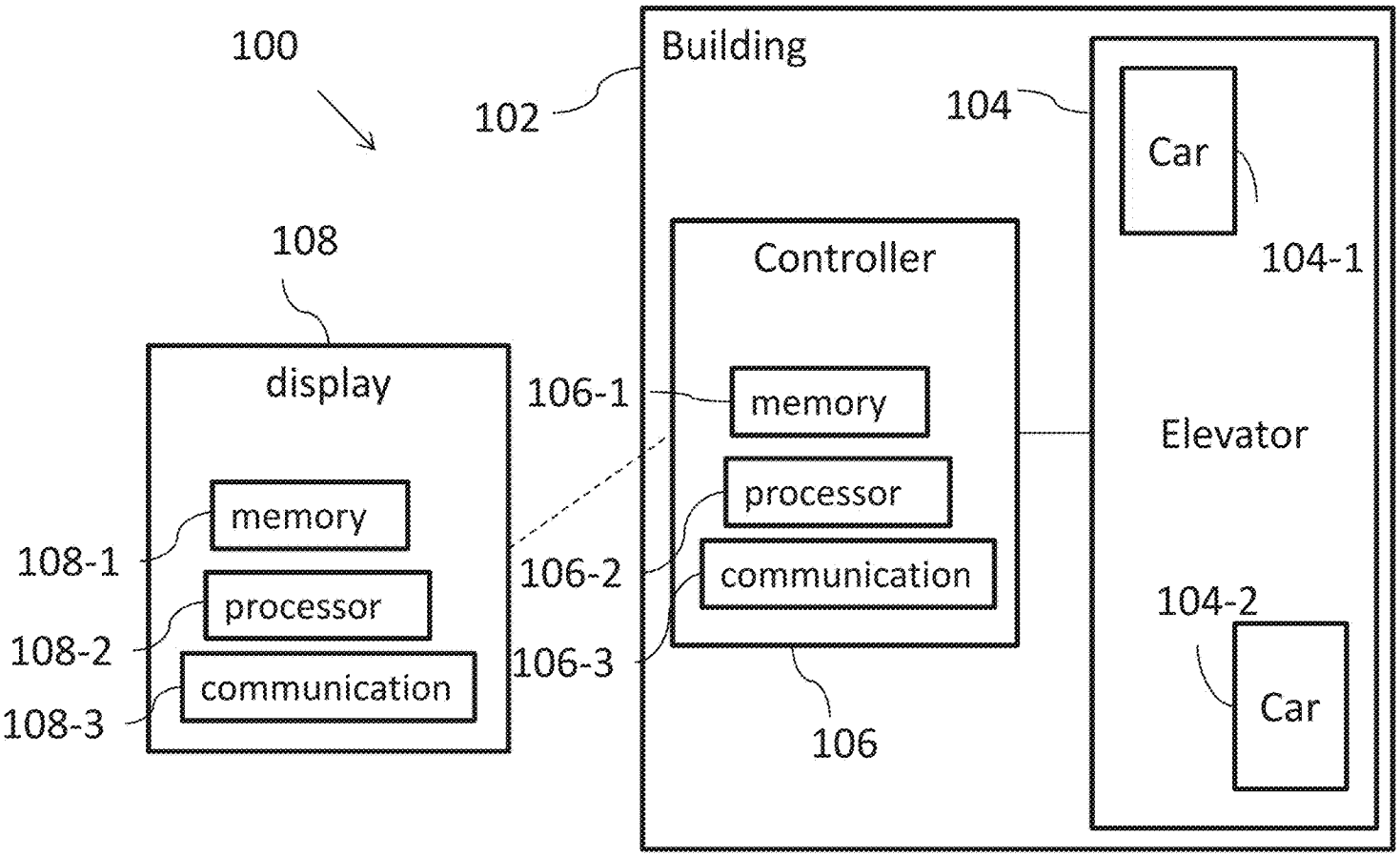
FIG. 1 depicts an elevator system in accordance with one or more embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Embodiments described herein are directed to a method and system for orchestrating an evacuation operation using an elevator. For example, according to one or more embodiments, a system is provided that provides a means for building occupants to easily request an evacuation without any knowledge of the egress (destination) landing. Additionally, according to one or more embodiments, a system is provided that specifies the number of occupants waiting to be evacuated from each landing or floor. Additionally, according to one or more embodiments, a system is provided that announces elevator arrival and directs occupants towards the proper elevator. Finally, according to one or more embodiments, a system is provided at landings not being evacuated, the elevator system fixtures shall indicate all elevators are out of service.

Turning now to the figures, FIG. 1 depicts an elevator system 100 in accordance with one or more embodiments. The elevator system 100 is shown installed at a building 102. In some embodiments, the building 102 may be an office building or a collection of office buildings that may or may not be physically located near each other. The building 102 may include a number of floors. Persons entering the building 102 may enter at a lobby floor, or any other floor, and may go to a destination floor via one or more conveyance devices, such as an elevator 104.

The elevator 104 may be coupled to one or more computing devices, such as a controller 106. The controller 106 may be configured to control dispatching operations for one or more elevator cars (e.g., cars 104-1, 104-2) associated with the elevator 104. The elevator cars 104-1 and 104-2 may be located in the same hoist way or in different hoist ways so as to allow coordination amongst elevator cars in different elevator banks serving different floors. It is understood that other components of the elevator system 100 (e.g., drive, counterweight, safeties, etc.) are not depicted for ease of illustration.

Also shown in FIG. 1 is a mobile device 108. The mobile device 108 may include a device that is typically carried by a person, such as a phone, PDA, electronic wearable, RFID tag, laptop, tablet, watch, or any other known portable mobile device. The mobile device 108 may include a processor 108-2, a memory 108-1, and a communication module 108-3 as shown in FIG. 1. The processor 108-2 can be any type or combination of computer processors, such as a microprocessor, microcontroller, digital signal processor, application specific integrated circuit, programmable logic device, and/or field programmable gate array. The memory 108-1 is an example of a non-transitory computer readable storage medium tangibly embodied in the mobile device 108 including executable instructions stored therein, for instance, as firmware. The communication module 108-3 may implement one or more communication protocols as described in further detail herein.

The controller 106 may include a processor 106-2, a memory 106-1, and communication module 106-3 as shown in FIG. 1. The processor 106-2 can be any type or combination of computer processors, such as a microprocessor, microcontroller, digital signal processor, application specific integrated circuit, programmable logic device, and/or field programmable gate array. The memory 106-1 is an example of a non-transitory computer readable storage medium tangibly embodied in the controller 106 including executable instructions stored therein, for instance, as firmware. The communication module 106-3 may implement one or more communication protocols as described in further detail herein.

The mobile device 108 and the controller 106 communicate with one another. According to one or more embodiments, the communication between the mobile device 108 and the controller 106 is done through other systems such as transmitters, converters, receivers, and other transmitting and processing elements depending on the communication type selected. For example, the mobile device 108 and the controller 106 may communicate with one another when proximate to one another (e.g., within a threshold distance). The mobile device 108 and the controller 106 may communicate over a wireless network, such as 802.11x (WiFi), short-range radio (Bluetooth), or any other known type of wireless communication. In some embodiments, the controller 106 may include, or be associated with (e.g., communicatively coupled to) a networked element, such as kiosk, beacon, hall call fixture, lantern, bridge, router, network node, etc. The networked element may communicate with the mobile device 108 using one or more communication protocols or standards. For example, the networked element may communicate with the mobile device 108 using near field communications (NFC), or any type of known wired or wireless communication means. According to one or more other embodiments, the networked element may communicate with the mobile device 108 through a cellular network or over the internet through a number of other devices outside the building.

In other embodiments, the controller 106 may establish communication with a mobile device 108 that is outside of the building 102. This connection may be established with various technologies including GPS, triangulation, or signal strength detection, by way of non-limiting example. The communication connection that can be established includes, but is not limited to, a cellular connection, a WiFi connection, a Bluetooth connection, a peer-to-peer connection, a satellite connection, a NFC connection, some other wireless connection, and even a wired connection using an Ethernet cable, coaxial cable, or other data cable. These communication connections may transport data between the mobile device 108 using a number of different networks ranging from a private secure direct communication link to transporting the data over the internet through multiple different servers, switches, etc. Such technologies that allow early communication will provide users and the systems more time to establish the most efficient passenger flow, and may eliminate the need for a user to stop moving to interact with the system.

Implementation of a method and system of orchestrating an evacuation operation using the mobile device, controller, and elevator is described with reference to FIGS. 2-5.

Figure 2:
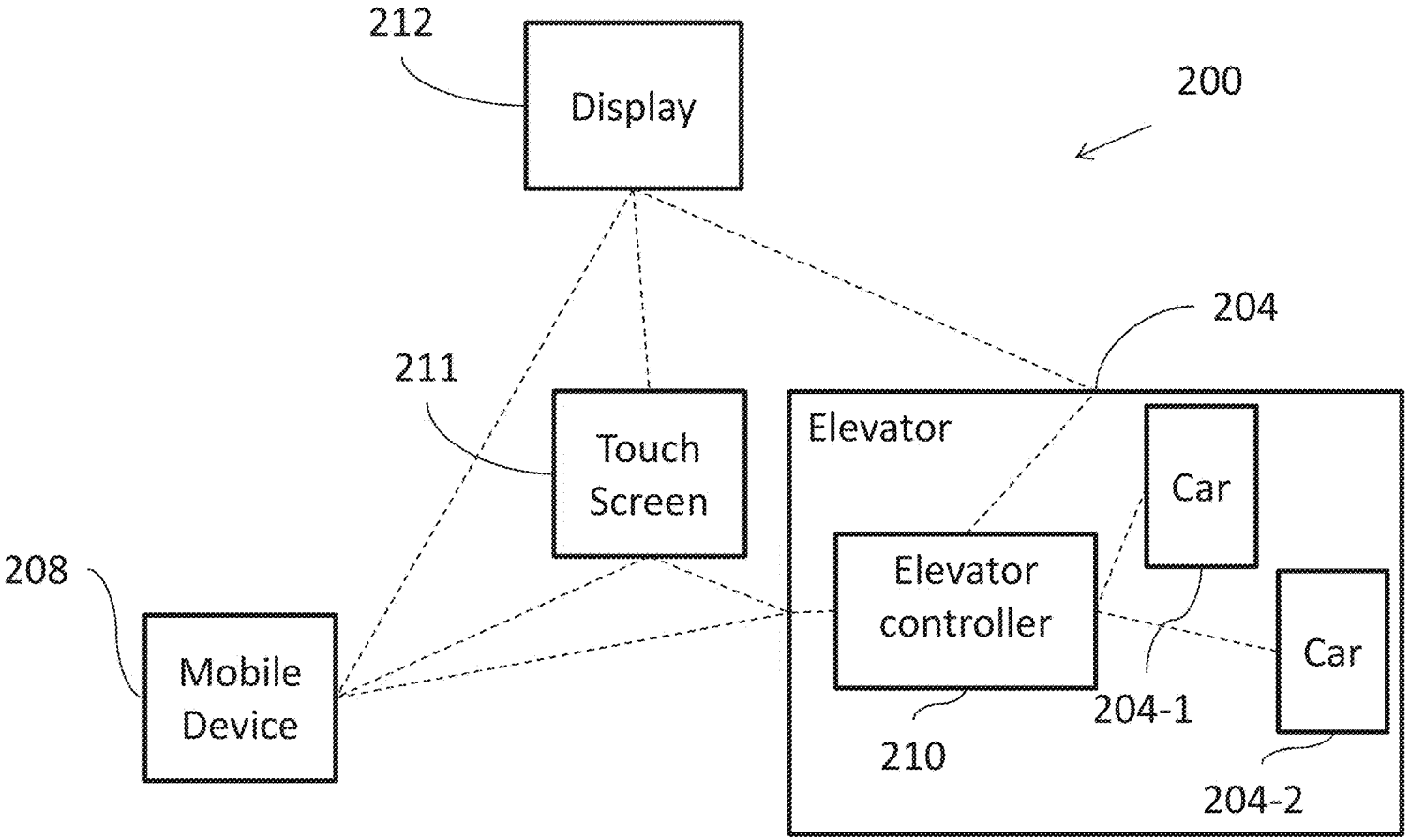
FIG. 2 depicts a system for orchestrating an evacuation operation using an elevator in accordance with one or more embodiments of the present disclosure.

Referring to FIG. 2, a system 200 for orchestrating an evacuation operation using an elevator in accordance with one or more embodiments is shown. The system 200 includes at least one elevator 204, a mobile device 208, a fixed display 212, and a touch screen 211. According to one or more embodiments, the fixed display may be located anywhere within the building. Similarly, the touch screen 211 may be located anywhere within the building at a position where users can access the touch screen 211. According to one or more embodiments, the system 200 may include a plurality of mobile devices, touch screens, and/or fixed displays. According to another embodiment, the system 200 may include other input devices similar to a touch screen such as a keypad, elevator buttons, voice activated input, image gesture activation using an image sensor, and other known input devices. The elevator 204 includes one or more cars 204-1, 204-2 as well as a controller 210. The elevator controller 210 is shown within the elevator system 100, but may be located elsewhere as shown in FIG. 1.

According to one embodiment, the method of orchestrating an evacuation operation using an elevator includes receiving an evacuation request from a mobile device 208 and/or a touch screen 211 at the elevator controller 210. The elevator controller 210 will process the evacuation request by determining what car to send and calling one of the cars 204-1 or 204-2. The elevator controller 210 will also generate and transmit evacuation information that is configured to be shown on one or more than one of the mobile device 208, the touch screen 211, and a display 212. Accordingly, a user can view the status of their evacuation request on multiple devices or locations.

According to one or more embodiments, the evacuation information to be displayed may include an image, a video, an audio output, text, or any combination thereof, as described in more detail below. Further, according to one or more embodiments, the touch screen 211 may be a kiosk display, a display located adjacent to an elevator car bay door, a display on the same floor as the user, a display within visual range of the user, a display within wireless communication range of a user, or a display within a defined range detectable using wireless communication and positioning. The display 212 may be a fixed display mounted above the top of an elevator car bay door, a display located adjacent to an elevator car bay door, a display on the same floor as the user, a display within visual range of the user, a display within wireless communication range of a user, or a display within a defined range detectable using wireless communication and positioning FIGS. 3A and 3B depict a user 306 and a system 300 for orchestrating an evacuation operation using an elevator in accordance with one or more embodiments of the present disclosure.

Figure 3A:
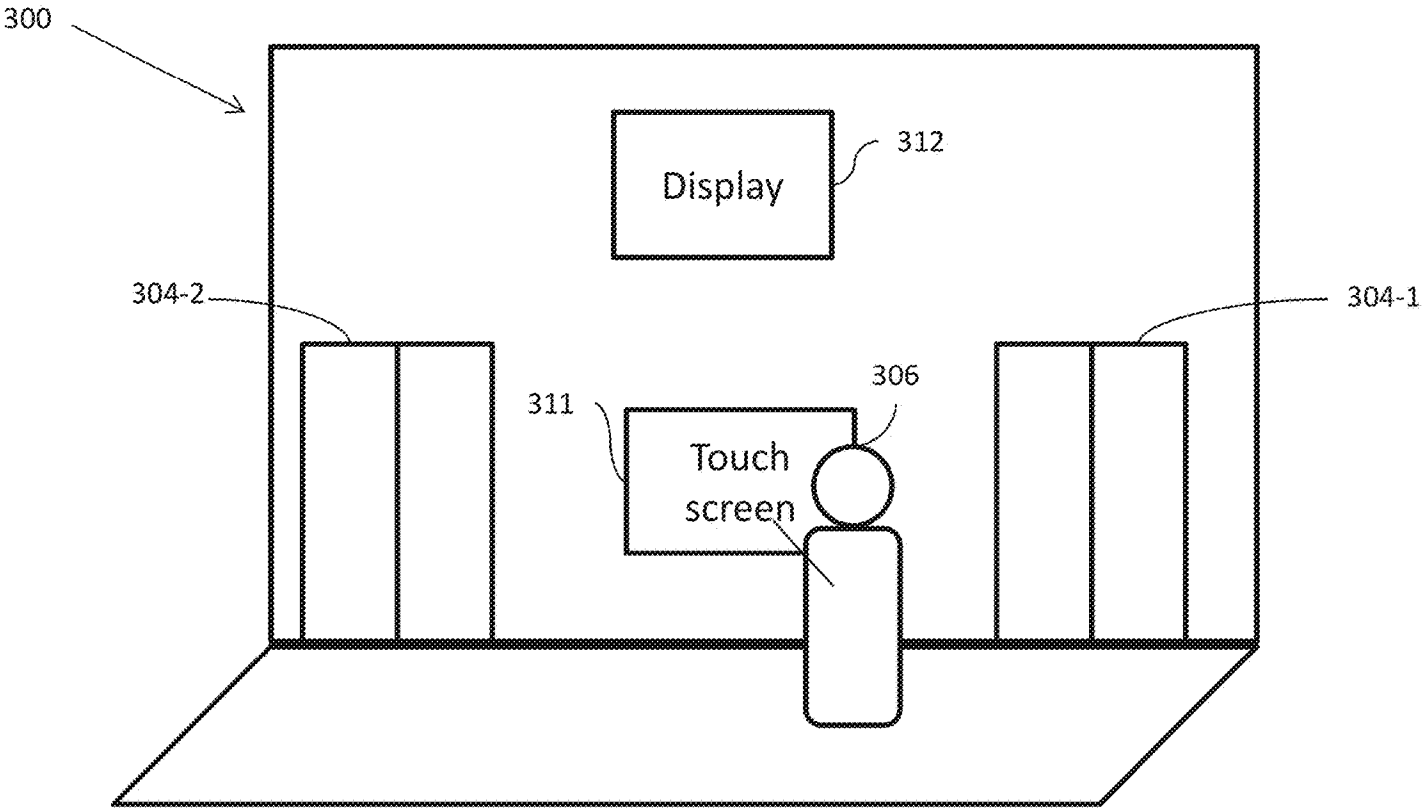
FIGS. 3A and 3B depict a user and a system for orchestrating an evacuation operation using an elevator in accordance with one or more embodiments of the present disclosure.

FIG. 3A depicts use of a stationary touch screen 311 by a building occupant 306. According to another embodiment, the system 300 may include other input devices similar to a touch screen such as a keypad, elevator buttons, voice activated input, image gesture activation using an image sensor, and other known input devices. The occupant 306 is at the elevator landing where multiple elevators 304-1 and 304-2 may be available. In other embodiments, less or more elevators may exist on a landing floor. There is also the touch screen 311 and the display 312. The touch screen 311 is where the user may request evacuation utilizing the touch screen capabilities. According to another embodiment, the system 300 may include other input devices similar to a touch screen such as a keypad, elevator buttons, voice activated input, image gesture activation using an image sensor, and other known input devices that can be used to request evacuation. In other embodiments, the same touch screen 311 would notify the occupant of an elevator's anticipated arrival time. In other embodiments, the same touch screen 311 would notify the occupant of the number of other occupants waiting for the elevator for evacuation. In other embodiments, the same touch screen 311 would notify the occupant that all elevators are out of service if the occupant is located on a landing floor wherein evacuation is not necessary. The display 312 would show all the same things, or potentially different things, as the touch screen 311, though would not allow the occupant to actually request an evacuation.

Figure 3B:
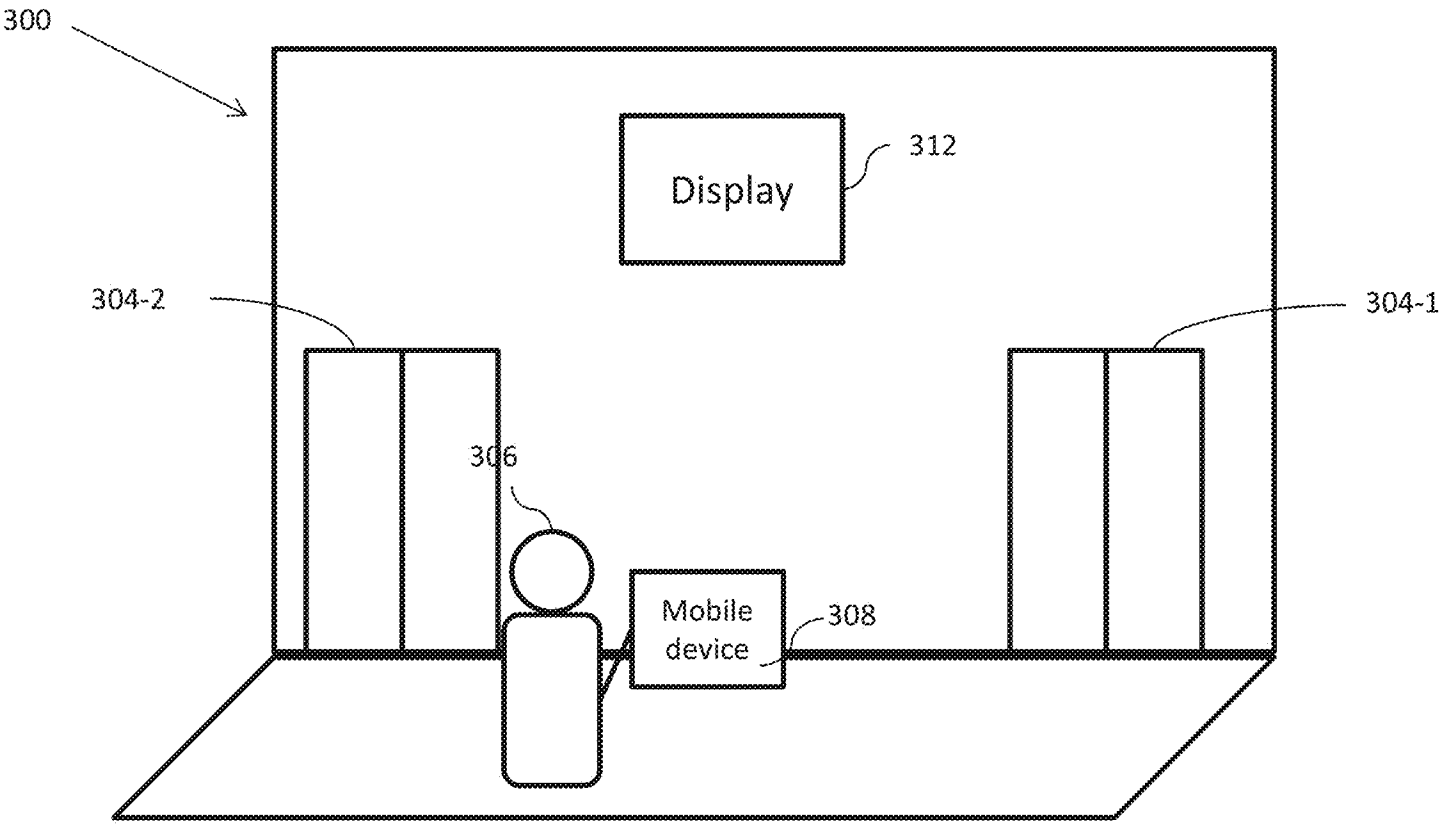

FIG. 3B depicts use of a mobile device 308 by a building occupant 306. The occupant 306 is at the elevator landing where multiple elevators 304-1 and 304-2 may be available. In other embodiments, less or more elevators may exist on a landing floor. There is also mobile device 308 and the display 312. The mobile device 308 is the personal mobile device of the user, and in different embodiments, may be a cellular phone, a PDA, or a laptop. The mobile device 308 is where the user may request evacuation utilizing the user interface capabilities of the application for the elevator system. In other embodiments, the same mobile device 308 would notify the occupant of an elevator's anticipated arrival time. In other embodiments, the same mobile device 308 would notify the occupant of the number of other occupants waiting for the elevator for evacuation. In other embodiments, the same mobile device 308 would notify the occupant that all elevators are out of service if the occupant is located on a landing floor wherein evacuation is not necessary. The display 312 would show all the same, or different things as the mobile device 308, though would not allow the occupant to actually request an evacuation.

Figure 4A:
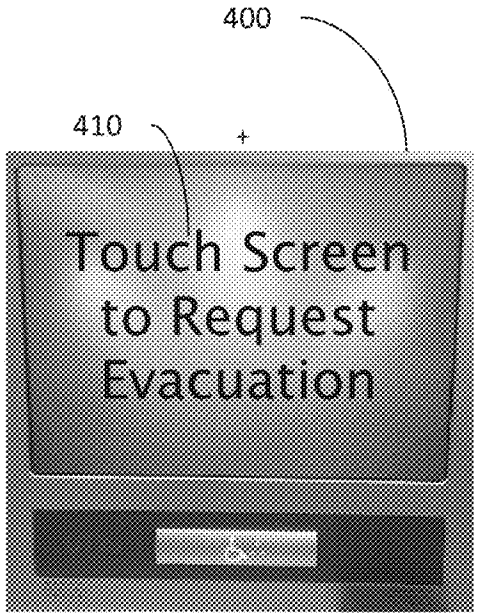
FIGS. 4A through 4C depict graphical user interfaces for use with a system and method of orchestrating an evacuation operation using an elevator in accordance with one or more embodiments of the present disclosure.
Figure 4B:
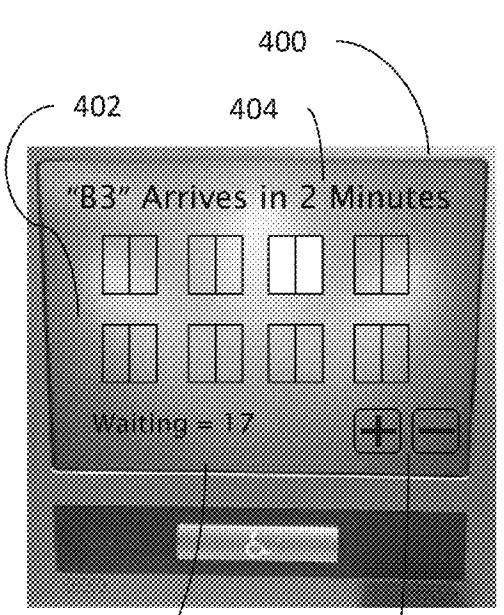
Figure 4C:
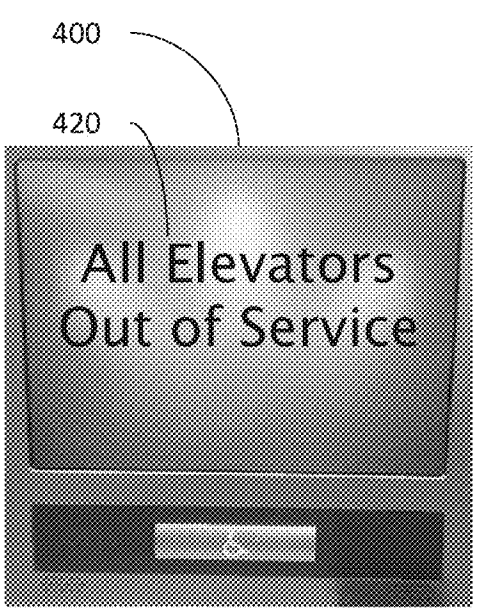

FIGS. 4A through 4C depict examples of graphical user interfaces for use with a system and method of orchestrating an evacuation operation using an elevator in accordance with one or more embodiments of the present disclosure. These GUIs are non-limiting examples as other arrangements can be envisioned and are included as embodiments. For example, the GUI may include an icon that signifies evacuation. Alternatively, according to another embodiment, the GUI may display a video indicating evacuation procedures and evacuation related information. According to another embodiment, the GUI may display a map with overlaid information. Further, the GUI may include different arrangements of input buttons and menus that can be tailored for the specific building and elevator system that it is being used with.

FIG. 4A depicts the graphical user interface for requesting evacuation via elevator 410 in accordance with one or more embodiments. In some embodiments, this graphical user interface may be on an occupant's personal mobile device, including but not limited to, a cellular phone, a PDA, or a laptop. In some embodiments, this graphical user interface may be on a stationary touch screen kiosk 400 located at the landing with the elevators. In an evacuation scenario, an occupant would see the command to "touch screen to request evacuation" on the stationary touch screen kiosk and/or on the mobile device of the user (400). The occupant would touch the screen to request an elevator for evacuation.

FIG. 4B depicts the graphical user interface on the stationary touch screen kiosk 400 for viewing details of expected arrival information of different elevators for evacuation purposes to the landing requested. According to another embodiment, the system may include other input devices similar to a touch screen such as a mobile device, a keypad, elevator buttons, voice activated input, image gesture activation using an image sensor, and other known input devices. Some of these input devices may have an associated display that can show the graphical user interface. The graphical user interface would show the expected arrival time of different elevators for evacuation purposes (404). The graphical user interface would show the specific elevator that is due to arrive (402) through an image selection, providing a visual representation of the arriving elevator's location. In some embodiments, multiple elevators may be listed to arrive (404) and visually highlighted (402). The graphical user interface would also show the number of occupants waiting (406). In some embodiments, this number would be based on the number of occupants who requested the elevator from only the stationary touch screen kiosk (400), while in other embodiments, this number would reflect occupants who requested from either the stationary touch screen kiosk (400) or from their mobile device. In some embodiments, to prevent occupant manipulation of the number of people waiting either through requesting an elevator on both the stationary touch screen kiosk (400) and a mobile device, or by a single occupant making multiple requests on the stationary touch screen kiosk (400) by selecting the additional occupant button (408), the sensor system installed would be able to use various data points, including but not limited to, weight on the floor and visual confirmation of bodies present, to ensure the number waiting is not artificially manipulated by the users. In other embodiments, once an initial evacuation request is made, the graphical user interface depicted in FIG. 4B would be the constant display, rather than reverting to the graphical user interface depicted in FIG. 4A, to allow newly arriving occupants to make an evacuation request by changing the number of people waiting (406) by selecting the addition button (408). Similarly, if an occupant decides to utilize another method of evacuation, the occupant may decrease the number of people waiting (406) by selecting the subtraction button (408).

FIG. 4C depicts the graphical user interface indicating to the user that all elevators are out of service 420. This message would display for all landing floors in which an evacuation was not necessary or possible, to allow elevators to accommodate occupants requiring evacuation from floors experiencing an evacuation scenario. In some embodiments, this graphical user interface may be on an occupant's personal mobile device, including but not limited to, a cellular phone, a PDA, or a laptop. In some embodiments, this graphical user interface may be on a stationary touch screen kiosk (400) located at the landing with the elevators.

Figure 5:
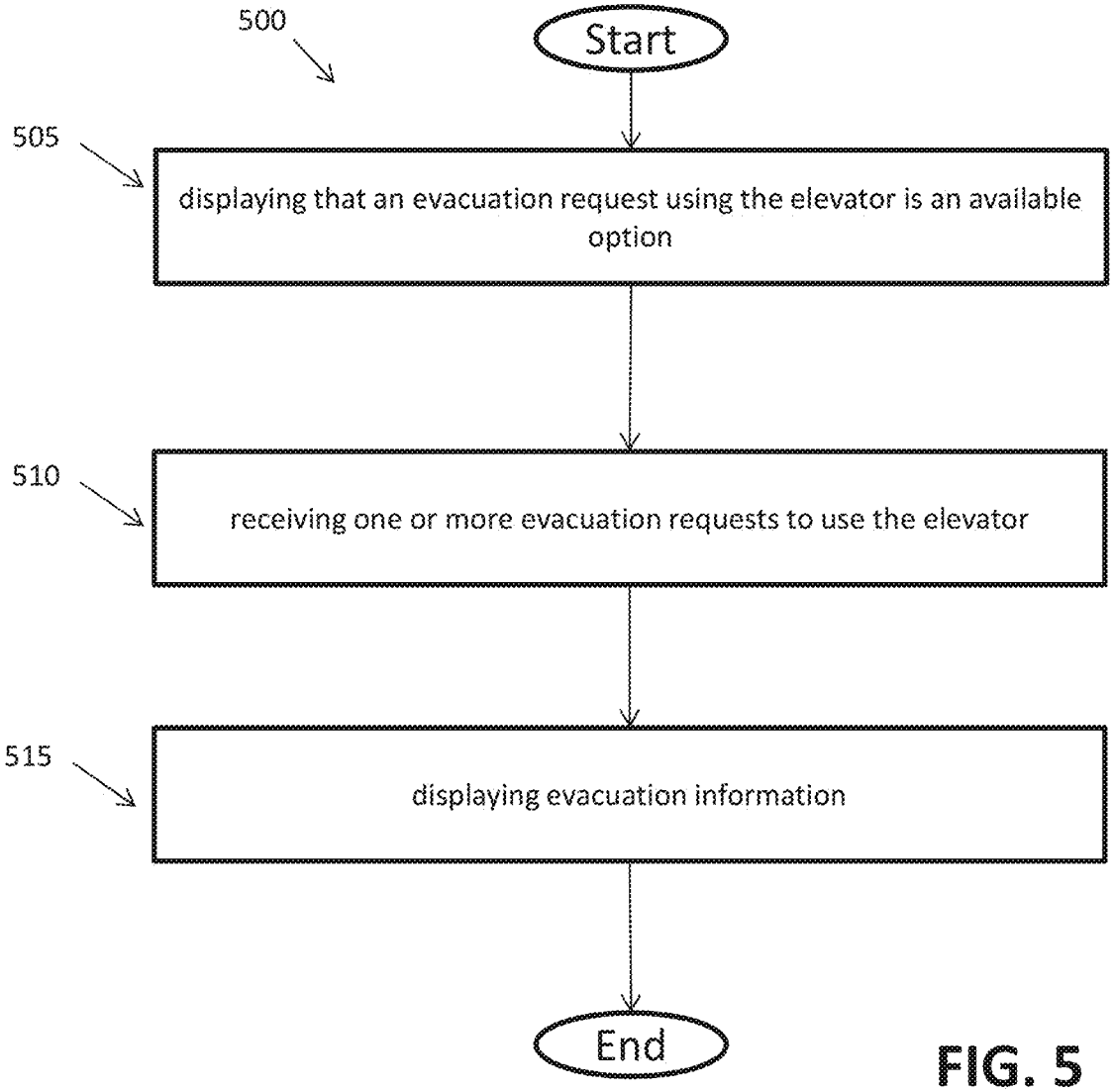
FIG. 5 depicts a flow diagram of a method of orchestrating an evacuation operation using an elevator in accordance with one or more embodiments of the present disclosure.

FIG. 5 depicts a flow diagram of a method of orchestrating an evacuation operation using an elevator (500) in accordance with one or more embodiments of the present disclosure. This method includes first displaying that an evacuation request using the elevator is an available option (operation 505). This method includes next receiving one or more evacuation requests to use the elevator (operation 510). This method includes lastly displaying evacuation information (operation 515).

According to another embodiment, the method can further include displaying that all elevators are out of service when an evacuation condition is met. For example, the evacuation condition is one selected from an elevator blockage, an elevator breakage, an elevator power loss, and an elevator being compromised by emergency situation. According to another embodiment, the method may further include automatically setting a destination of the elevator based on evacuation settings. For example, during an evacuation when a passenger requests an elevator for evacuation the elevator that is called will automatically be programmed with the destination floor to which the passenger will be taken. For example, the elevator can be programmed to take all evacuating passengers to the lobby. Or, according to another embodiment, if the lobby is compromised due to an emergency situation, the elevator can be programmed to take passengers to a skywalk level or to a basement level thereby bypassing the lobby floor.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description has been presented for purposes of illustration and description, but is not intended to be exhaustive or limited to the embodiments in the form disclosed. Many modifications and variations will be apparent to those of ordinary skill in the art without departing from the scope of the disclosure. The embodiments were chosen and described in order to best explain the principles of the disclosure and the practical application, and to enable others of ordinary skill in the art to understand various embodiments with various modifications as are suited to the particular use contemplated.

The present embodiments may be a system, a method, and/or a computer program product at any possible technical detail level of integration. The computer program product may include a computer readable storage medium (or media) having computer readable program instructions thereon for causing a processor to carry out aspects of the present disclosure.

The computer readable program instructions may execute entirely on the user's mobile device, partly on the user's mobile device, as a stand-alone software package, partly on the user's mobile device and partly on a remote computer or entirely on the remote computer or server. In the latter scenario, the remote computer may be connected to the user's mobile device through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Accordingly, the present disclosure is not to be seen as limited by the foregoing description, but is only limited by the scope of the appended claims.

What is claimed is:

1. A computer program product for orchestrating an evacuation operation using an elevator, the computer program product comprising a computer readable storage medium having program instructions embodied therewith, the program instructions executable by a processor to cause the processor to:

display that an evacuation request using the elevator is an available option;

receive one or more evacuation requests to use the elevator; and display evacuation information;

in response to the evacuation request being made, display a user interface comprising a number of people waiting, an elevator arrival time estimate and an elevator indicator;

the user interface comprising an addition button to increase the number of people waiting for evacuation and associated with the evacuation request and a subtraction button to decrease the number of people waiting for evacuation and associated with the evacuation request;

wherein the user interface further comprises a count of evacuation requests.

2. The computer program product of claim 1, the computer program product comprising additional program instructions executable by the processor to cause the processor to:

display that the evacuation request using the elevator is the available option on one or more displays selected from a fixed touch screen, a fixed keypad screen, and a mobile device.

3. The computer program product of claim 1, the computer program product comprising additional program instructions executable by the processor to cause the processor to:

display the evacuation information on one or more displays selected from a fixed touch screen, a fixed keypad screen, and a mobile device.

4. The computer program product of claim 1, the computer program product comprising additional program instructions executable by the processor to cause the processor to:

display on a second screen, wherein the second screen is a fixed screen mounted in an elevator lobby, the evacuation information, wherein the second screen is mounted at a height that is equal to or higher than a top of an elevator door entrance.

5. The computer program product of claim 1, the computer program product comprising additional program instructions executable by the processor to cause the processor to:

notify using an audio signal that the evacuation request using the elevator is the available option; and notify using an audio signal the evacuation information that is being displayed.

6. The computer program product of claim 1, the computer program product comprising additional program instructions executable by the processor to cause the processor to:

display that at least one elevator of a multi-elevator system is out of service when an evacuation condition is met, wherein the evacuation condition is one selected from an elevator blockage, an elevator breakage, an elevator power loss, and an elevator being compromised by emergency situation.

7. A method for orchestrating an evacuation operation using an elevator, the method comprising:

displaying that an evacuation request using the elevator is an available option;

receiving one or more evacuation requests to use the elevator; and displaying evacuation information;

in response to the evacuation request being made, displaying a user interface comprising a number of people waiting, an elevator arrival time estimate and an elevator indicator;

the user interface comprising an addition button to increase the number of people waiting for evacuation and associated with the evacuation request and a subtraction button to decrease the number of people waiting for evacuation and associated with the evacuation request;

wherein the user interface further comprises a count of evacuation requests.

8. The method of claim 7, further comprising:

display that the evacuation request using the elevator is the available option on one or more displays selected from a fixed touch screen, a fixed keypad screen, and a mobile device.

9. The method of claim 7, further comprising:

display the evacuation information on one or more displays selected from a fixed touch screen, a fixed keypad screen, and a mobile device.

10. The method of claim 7, further comprising:

display on a second screen, wherein the second screen is a fixed screen mounted in an elevator lobby, the evacuation information, wherein the second screen is mounted at a height that is equal to or higher than a top of an elevator door entrance.

11. The method of claim 7, further comprising:

notify using an audio signal that the evacuation request using the elevator is the available option; and notify using an audio signal the evacuation information that is being displayed.

12. The method of claim 7, further comprising:

display that at least one elevator of a multi-elevator system is out of service when an evacuation condition is met, wherein the evacuation condition is one selected from an elevator blockage, an elevator breakage, an elevator power loss, and an elevator being compromised by emergency situation.

13. A computer program product for orchestrating an evacuation operation using an elevator, the computer program product comprising a computer readable storage medium having program instructions embodied therewith, the program instructions executable by a processor to cause the processor to:

display that an evacuation request using the elevator is an available option;

receive one or more evacuation requests to use the elevator; and display evacuation information;

in response to the evacuation request is made, display a user interface comprising a count of evacuation requests and a number of people waiting;

the user interface comprising an addition button to increase the number of people waiting for evacuation and associated with the evacuation request and a subtraction button to decrease the number of people waiting for evacuation and associated with the evacuation request.

* * * * *